United States Patent [19]

Magdesyan et al.

[11] Patent Number: 4,695,118

[45] Date of Patent: Sep. 22, 1987

[54] BATTERY TERMINAL POST CLAMP

[76] Inventors: Garnik Magdesyan; Stepan Magdesyan, both of 436 Wilber Pl., Apt. D, Montebello, Calif. 90640; Leon P. Boodanian, 526 Griswold St., Glendale, Calif. 91205

[21] Appl. No.: 751,024

[22] Filed: Jul. 2, 1985

[51] Int. Cl.[4] ..... H01R 11/26

[52] U.S. Cl. ..... 439/726; 439/756

[58] Field of Search ..... 339/224, 225, 235, 236, 339/238, 239, 274, 278 D

[56] References Cited

U.S. PATENT DOCUMENTS 1,854,328 4/1932 Binder ..... 339/224
2,257,013 9/1941 Johnson ..... 339/238
3,377,609 4/1968 Shannon et al. ..... 339/224
4,294,505 10/1981 Gaffney ..... 339/238

*Primary Examiner*—Gil Weidenfeld
*Assistant Examiner*—Paula A. Austin
*Attorney, Agent, or Firm*—Jack C. Munro

[57] ABSTRACT

An electrically conducting battery terminal post clamp which does not require the use of any separate fastener assembly. The clamp includes a cam member movable from an unlocked position to a locked position. With the cam member in the locked position, pressure is applied to the battery terminal post compressing such against a bare wire end of an electrical conductor. The electrical conductor is located within a hole formed within the clamp.

5 Claims, 9 Drawing Figures

BATTERY TERMINAL POST CLAMP

BACKGROUND OF THE INVENTION

The field of this invention relates to clamps and more particularly to a new and novel boltless clamp for a battery terminal post.

The use of batteries to produce electrical power has long been known. Although batteries take numerous shapes, a common shape is a box-like housing which is composed of a plurality of cells connected together and having a positive and negative electrical connection on the upper surface of the battery housing. These positive and negative electrical connections are frequently termed "terminal posts". These types of batteries are generally rechargeable. Such batteries are frequently used in automobiles, trucks, earth moving equipment and other types of vehicles. Also, such types of batteries are used in stationary equipment such as generators and the like.

It is necessary to connect an electrical conductor to each terminal post of the battery. The most commonly used type of connection comprises an encircling clamp which is snugly mounted over a terminal post. This clamp is electrically connected to an electrical conductor which is to be usable to conduct electricity to electrically operated equipment. The clamp normally includes a bolt fastener assembly which is to be separately tightened for securing the clamp in position about the terminal post.

If it is necessary to replace the battery, these bolt fasteners must be loosened to permit disengagement of the clamps from each of the terminal posts of the battery. Also, it is generally advisable as normal maintenance procedure to periodically remove the clamps to clean both the clamps and the posts to avoid buildup of a corrosive layer which prevents the conducting of electricity from the terminal posts into the electrical conductor. At times this maintenance procedure needs to be performed at inconvenient locations such as alongside a roadway or at night. At such an inconvenient location, the individual may not readily have in his possesion the necessary tools to loosen the bolt so that the clamp can be removed for the maintenance procedure. Also, at times the replacement of a battery needs to be accomplished at, again, an inconvenient location and the individual doing the replacement may not have the tools necessary to remove the clamps.

There has long been a need to improve the battery clamp which would permit the battery clamp to be attached and detached from a battery terminal post without using any type of separate fasteners such as a bolt or screw.

SUMMARY OF THE INVENTION

The structure of the present invention is directed to a clamp that is formed of a housing within which is located an enlarged internal opening. A battery terminal post is to be locatable in a snug fitting manner within this enlarged internal opening. Also, formed within the housing is a tangentially located open-ended hole within which is to be located the bare wire end of an electrical conductor. This hole connects with the enlarged opening and the bare wire end of the electrical connector will physically abut against the terminal post. also, formed within the housing is an open-ended slot within which is pivotally mounted a handle. The handle is to be movable from a locked position to an unlocked position. In moving the handle from the unlocked position to the locked position, the handle is connected to a cam which presses against the terminal post and in turn lightly presses the terminal post against the bare wire at the end of the electrical conductor. The handle member can be permanently fixed to the housing or can be removably connected thereto. The housing may include a locking device which can be moved to lock the handle in the locked position. There also may be a rubber or plastic sheath that the clamp housing can be slid into to substantially encase the clamp in an airtight environment.

The principal objective of the present invention is to construct a clamp for a battery terminal post which can be operated to tightly clamp onto the post achieving a direct connection between the terminal post and the bare end of an electrical conducting wire without using of any separate fastener such as a bolt.

Another objective of this invention is to construct a clamp for a battery terminal post which minimizes periodic maintenance.

Another objective of this invention is to construct a clamp which can be manufactured inexpensively and, therefore, sold inexpensively to the consumer.

DETAILED DESCRIPTION OF THE SHOWN EMBODIMENT

Figure 1:
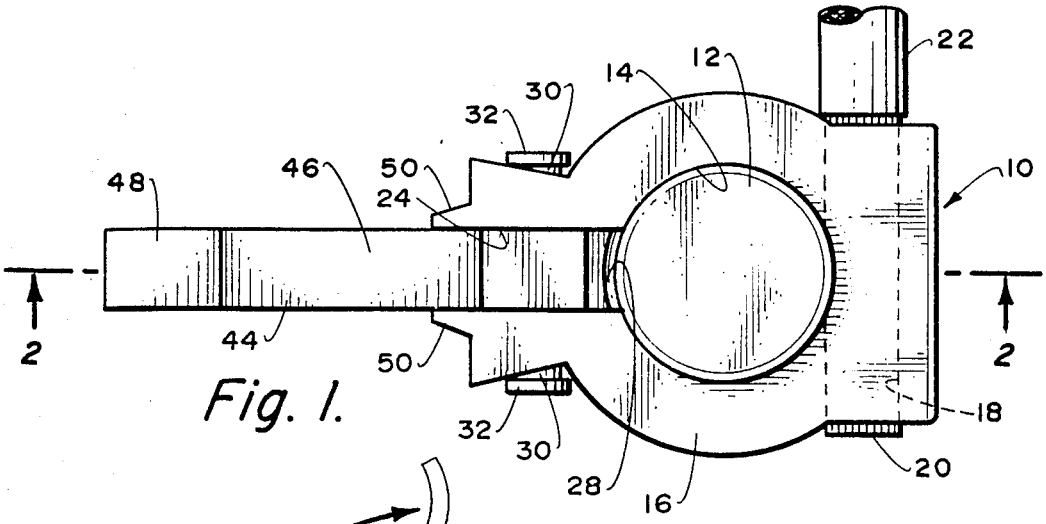
FIG. 1 is a top plan view of the clamp of this invention showing the clamp in position on a battery terminal post.

Referring particularly to the drawings there is shown the clamp 10 of this invention in FIGS. 1 through 4 which is to be securely mounted onto a conventional battery terminal post 12. The battery terminal post 12 is mounted on the top surface of a conventional battery (not shown). The battery terminal post 12 is constructed of an electrically conductive material.

The clamp 10 has a clamp housing 16 within which is located an enlarged internal opening 14. The terminal post 12 is to be snugly retained within the enlarged internal opening 14.

Also formed within the back end of the housing 16 is a hole 18. The hole 18 connects with enlarged internal opening 14 in a manner that the longitudinal center axis of the hole 18 is tangentially disposed with respect to the enlarged internal opening 14. The hole 18 is open-ended which permits a bare wire end 20 of an electrical conductor 22 to be inserted through one of the ends of the hole 18 and positioned so that the bare wire end 20 connects with the enlarged internal opening 14.

Also formed within the clamp housing 16 is an open-ended slot 24. One end of the slot 24 connects with the enlarged internal opening 14 with the other end connecting with the ambient. Within the slot 24 is located a cam member 26. The cam member 26 includes an inner cam surface 28. Fixedly mounted to the cam member 26, and extending on each side thereof a short distance from the cam member 28, is a pin 30. The pin 30 is shown within FIGS. 1 through 4 to be integral with the cam member 26. Each end of the pin 30 is formed into an enlarged head 32. With the cam member 26 properly positioned within the slot 24, the pin 30 is mounted within a pair of aligned openings 36 and 38 formed within the clamp housing 16. Opening 36 connects with enlarged opening section 40. In a similar manner, opening 38 connects with enlarged opening section 42.

Cam member 26 will have integrally formed thereto a handle section 44. Handle section 44 includes a thumb contactable arcuate smooth surface 46. The outer end of the handle section 44 includes an upturned end 48. The purpose of the upturned end 48 is to facilitate grasping onto the handle section 44 to effect movement of cam member 26 from the locked position shown in solid lines in FIG. 2 to the unlocked position shown in phantom in FIG. 2.

The cam member 26 as well as its handle section 44, upturned end 48, pin 30 and enlarged ends 32 are to be manufactured within FIGS. 1 through 4 as a single part. The housing 16 is manufactured as a separate single part. Just prior to usage, the user locates the handle member 26 within the enlarged internal opening 14 and then locates the pin 30 within the enlarged sections 40 and 42 of the openings 36 and 38, respectively. The enlarged heads 32 are passed readily through the enlarged sections 40 and 42 but are not capable of passing through the openings 36 and 38. The operator then locates the pin 30 within the openings 36 and 38 so that the enlarged heads 32 abuts against the exterior surface of the clamp housing 16. The user then locates the cam member 26 in the unlocked position shown in phantom lines in FIG. 2.

Figure 2:
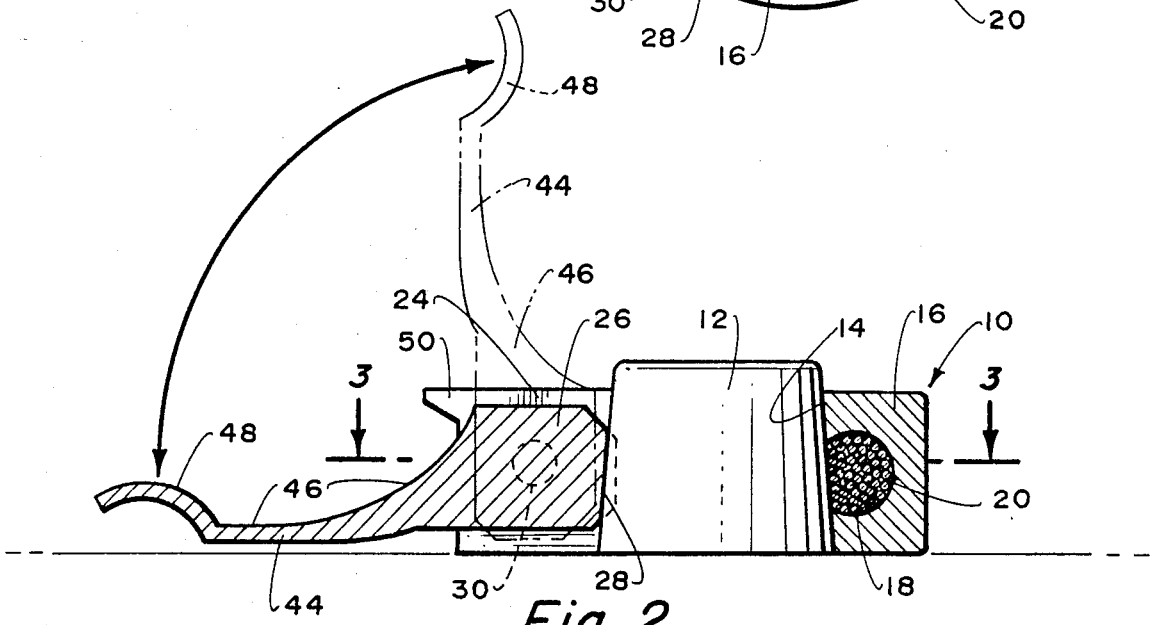
FIG. 2 is a cross-sectional view taken along line 2—2 of FIG. 1 depicting in phantom the unlocked position of the handle/cam member.
Figure 3:
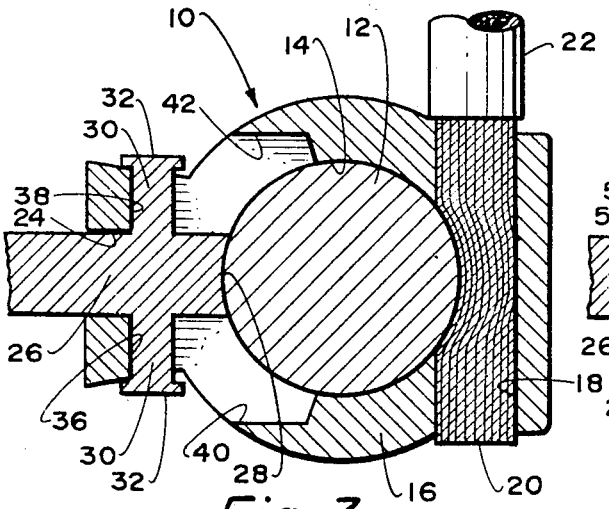
FIG. 3 is a cross-sectional view taken along line 3—3 of FIG. 2.

The user then proceeds to insert the bare wire end 20 within the hole 18. It is the option of the user as through which end of the hole 18 the bare wire end 20 is to be inserted. The user then places the enlarged internal opening 14 about the terminal post 12 and pushes such to a snug position which is usually when the top surface of the terminal post 12 is located above the top exterior surface of the clamp housing 16 as shown in FIG. 2. The user then proceeds to grasp the handle section 44 and apply pressure to the thumb contacting surface 46 to move the handle section 44 to the solid line position shown in FIG. 2. The solid line position is deemed the locked position with the phantom position being the unlocked position. When moving to the locked position, the cam 28 pushes against and actually slightly depresses into the terminal post 12. This relative movement causes the terminal post 12 to push tightly and somewhat deflect a portion of the bare wire end 20 as shown in FIG. 3 of the drawings. As a result, a tight electrical connection is established directly between the terminal post 12 and the bare wire end 20.

As a safety feature it may be desirable to lock the handle section 44 in the locked position. In order to accomplish this, there is included a pair of protrusions 50 extending from the housing 16 with one protrusion 50 located on one side of slot 24 with the other protrusion 50 located on the opposite side of slot 24. The operator only needs to take a conventional pair of pliers and slightly squeeze together the protrusions 50 which will cause such to deflect into the path of movement of the handle member 44 and will prevent the handle member 44 from being moved to the unlocked position.

Figure 5:
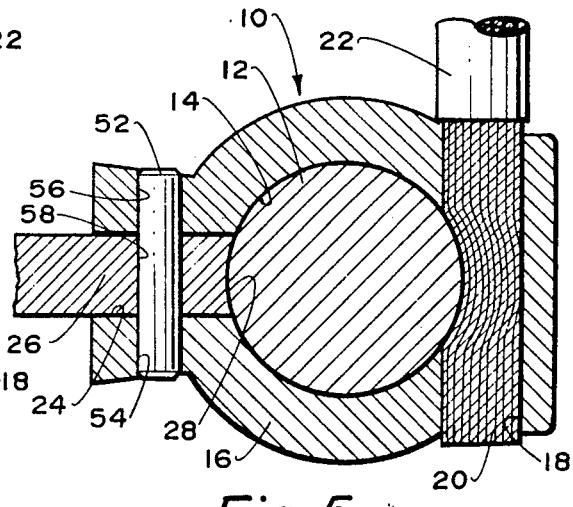
FIG. 5 is a view similar to FIG. 3 but of a modified form of the clamp of this invention in which the handle/cam member is not capable of being removed from the clamp housing.
Figure 4:
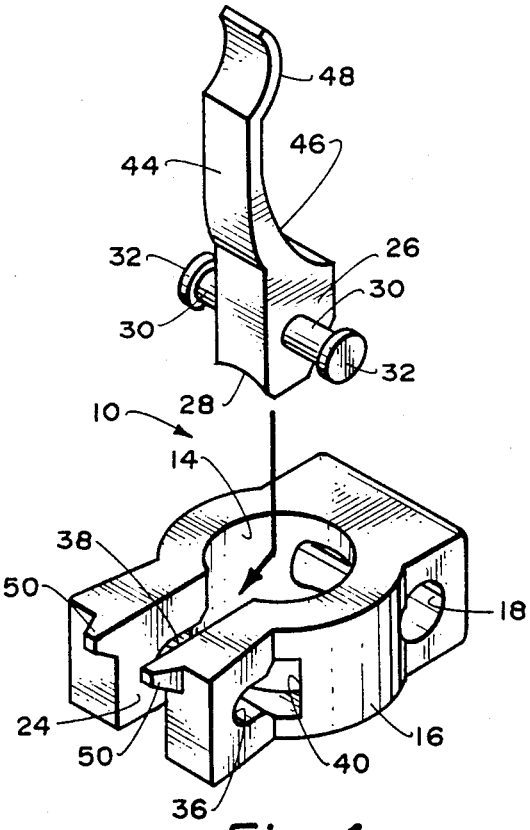
FIG. 4 is an exploded isometric view of the clamp of FIG. 1 showing the two parts of the clamp separate from one another.
Figure 6:
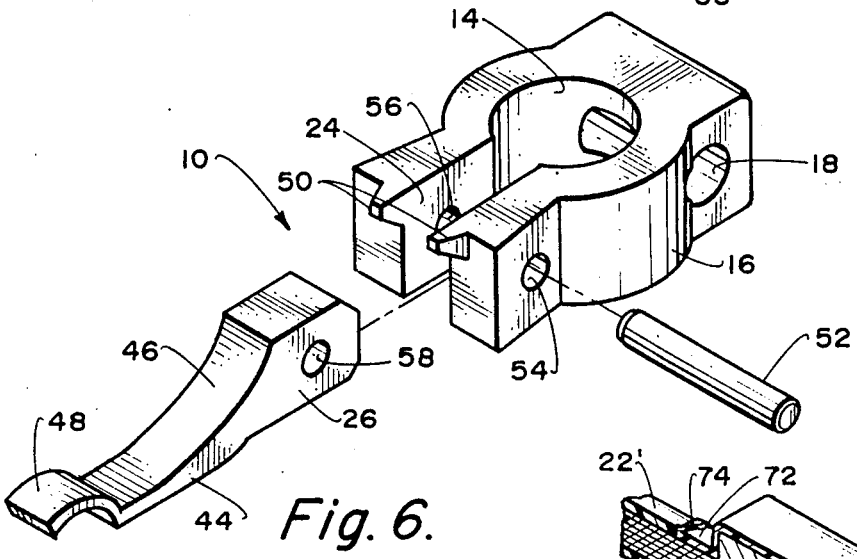
FIG. 6 is an exploded isometric view of the modified form of clamp of this invention shown in FIG. 5.

Referring particularly to FIG. 6, there is a modified form of clamp 10 of this invention in which similar numerals have been used to define similar parts. The only difference of the clamp of the FIGS. 5 and 6 from FIGS. 1 through 4 is that the cam member 26 is not removable from the housing 16. Instead, the cam member 26 is fixedly mounted to the housing 16 by means of a pin 52 which passes through aligned holes 54 and 56 formed within the clamp housing 16. When passing through the holes 54 and 56, the pin 52 also passes through hole 58 formed within the cam member 26. The holes 54 and 56 are slightly smaller in size than the hole 58 so that the pin 52 will establish an interference fit with the holes 54 and 56. The cam member 26 is capable of being pivoted relative to the pin 52 between the previously discussed locked position and unlocked position. It is to be noted, of course, that within FIGS. 5 and 6 that the enlarged sections 40 and 42 have been eliminated.

Figure 7:
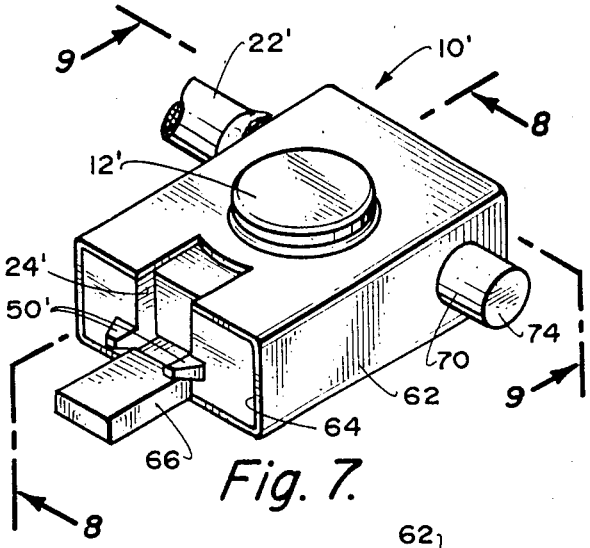
FIG. 7 is an isometric view of a third modified form of clamp of this invention showing the clamp having a protective sheath mounted thereabout.
Figure 8:
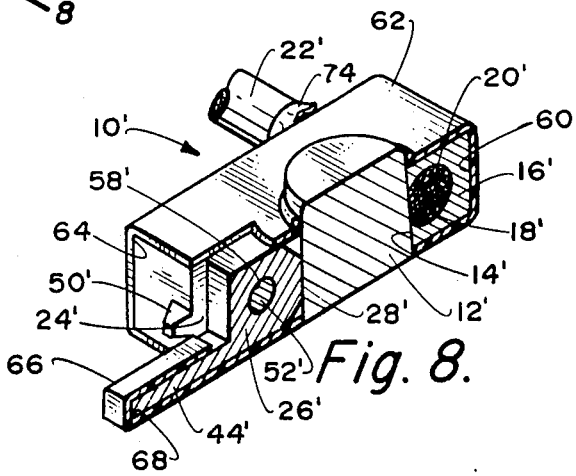
FIG. 8 is a cross-sectional view taken along line 8—8 of FIG. 7.
Figure 9:
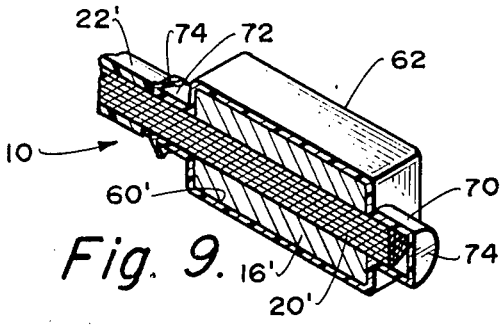
FIG. 9 is a cross-sectional view taken along line 9—9 of FIG. 7.

Referring particularly to FIGS. 7, 8 and 9, there is again shown a further modified form of clamp 10' of this invention. The clamp 10' is similar to the clamp of FIGS. 5 and 6 with the exception being that the clamp 10' has assumed a basic box-like shape that is somewhat different in exterior appearance than the clamp of FIG. 6. The reason for the difference of the exterior appearance of the clamp is so that it will closely conform within the compartment 60 of a sheet material plastic or rubber sheath 62. The sheath 62 is stretched over the exterior of the clamp housing 16 prior to being installed on the terminal post 12'. The sheath 62 includes an open front end 64. Adjacent this open front end 64 there is located an extension 66 of the sheath 62. Extension 66 includes an interior pocket 68. When positioning sheath 62 about the clamp housing 16', the user must physically grasp the extension 66 and direct such to locate the handle section 44 within the pocket 68. It is to be noted that within the configuration of clamp 10 shown in FIGS. 7 through 9, there is not utilized any upturned end 48 as within FIGS. 1 through 6.

With the sheath 62 in place about the clamp housing 16', upon the clamp housing 16' being installed onto terminal post 12', the electrical connection between the terminal post 12' and the bare wire end 20' of the electrical conductor 22' will be confined in a substantially airless environment, thereby minimizing the effect of a corrosive layer forming between the bare wire end 20' and the terminal post 12'.

The sheath 62 includes a pair of tubular extensions 70 and 72. The outer end of each of the tubular extensions 70 and 72 are normally each closed by a frangible cover 74. The thickness of cover 74 is less than the wall thickness of the tubular extensions 70 and 72. During insertion of the bare wire end 20' into hole 18', the user will cause the breaking of one of the frangible covers 74 with the other cover 74 remaining intact so that the electrical connection between the terminal post 12' and the bare wire end 20′ will remain in a substantially airless environment.

What is claimed is:

1. In combination with an electrically conductive battery terminal post, a clamp to be mounted on said post, an electrical conductor separate from said terminal post for conducting of electricity relative to said terminal post, said clamp comprising:

a housing having an enlarged internal opening, said post to be located within said internal opening in a snug fitting manner;

an open-ended slot formed within said housing said slot connecting with said enlarged internal opening;

a hole formed within said housing, said hole having a longitudinal center axis, said longitudinal center axis being tangentially disposed relative to said enlarged internal opening with said hole connecting with said enlarged internal opening, a portion of said electrical conductor to be located within said hole and physically contact said terminal post;

a cam member mounted within said slot connected by connecting means to said housing, said cam member being pivotable between a locked position and an unlocked position, when in said locked position said cam member being in tight contact with said terminal post causing deflection of a portion of said electrical conductor by said terminal post, when in said unlocked position said cam member being spaced from said terminal post permitting disengaging of said clamp from said terminal post;

said cam member being connected to a manually actuatable handle; and said clamp including locking means, said locking means being operable to maintain said cam member in said locked position preventing movement to said unlocked position.

2. The combination as defined in claim 1 wherein:

said locking means comprising a pair of manually deformable protrusions formed on said housing and extending therefrom.

3. In combination with an electrically conductive battery terminal post, a clamp to be mounted on said post, an electrical conductor separate from said terminal post for conducting of electricity relative to said terminal post, said clamp comprising:

a housing having an enlarged internal opening, said post to be located within said internal opening in a snug fitting manner;

an open-ended slot formed within said housing, said slot connecting with said enlarged internal opening;

a hole formed within said housing, said hole having a longitudinal center axis, said longitudinal center axis being tangentially disposed relative to said enlarged internal opening with said hole connecting with said enlarged internal opening, a portion of said electrical conductor to be located within said hole and physically contact said terminal post;

a cam member mounted within said slot connected by connecting means to said housing, said cam member being pivotable between a locked position and an unlocked position, when in said locked position said cam member being in tight contact with said terminal post causing deflection of a portion of said electrical conductor by said terminal post, when in said unlocked position said cam member being spaced from said terminal post permitting disengaging of said clamp from said terminal post;

said cam member being connected to a manually actuatable handle; and a sheath to be locatable about said housing in a close conforming manner, said sheath comprising a thin stretchable layer of material; and said sheath including an extension, said extension including a pocket, said extension being capable of being stretched sufficiently to locate said handle within said pocket.

4. The combination as defined in claim 3 wherein:

said sheath including frangible opening covers, said frangible opening covers being located directly adjacent said hole, a single said frangible opening cover being broken away during insertion of said electrical conductor within said hole.

5. The combination as defined in claim 4 wherein:

the wall thickness of said frangible opening covers being less than the wall thickness of said sheath.

* * * * *